United States Patent [19]

Kautz

[11] 4,085,995

[45] Apr. 25, 1978

[54] ELECTRICAL TERMINAL

[75] Inventor: Stephan Douglas Kautz, Mechanicsburg, Pa.

[73] Assignee: AMP Incorporated, Harrisburg, Pa.

[21] Appl. No.: 810,260

[22] Filed: Jun. 27, 1977

[51] Int. Cl.[2] ..... H01R 11/20
[52] U.S. Cl. ..... 339/97 R
[58] Field of Search ..... 339/97 R, 97 P, 98, 339/99 R

[56] References Cited

U.S. PATENT DOCUMENTS

| | | | |
|---|---|---|---|
| 3,422,391 | 1/1969 | Thompson | 339/97 R |
| 4,019,801 | 4/1977 | Hoffman | 339/98 |

FOREIGN PATENT DOCUMENTS

| | | | |
|---|---|---|---|
| 2,621,502 | 11/1976 | Germany | 339/97 P |

*Primary Examiner*—Joseph H. McGlynn
*Attorney, Agent or Firm*—Allan B. Osborne

[57] ABSTRACT

The present invention relates to an electrical terminal to which an insulated wire may be connected using a pair of pliers. More particularly, the invention includes an insulation cutting blade and meshing retaining walls.

2 Claims, 5 Drawing Figures

ELECTRICAL TERMINAL

BACKGROUND OF THE INVENTION

1. Field of the Invention

This invention is in the art of electrical terminals and more particularly those terminals to which an insulated wire may be terminated using ordinary household pliers.

2. Prior Art

Terminals of the type which connect a single electric wire to a stud such as on a low voltage transformer have been attached to the wire with solder or by crimping. In both cases the insulation on the wire needs to be removed from the end before such attaching takes place. Subsequent to the attaching, the wire for practical purposes is permanently fixed to the terminal. Further, in both cases, specialized tools are required to affect the attachment as well as some skill on the part of the person.

SUMMARY OF THE INVENTION

The present invention is an electrical terminal having a conventional tongue on one end and a novel insulation cutting blade and meshing retaining walls on the opposite end.

The object of the present invention is to provide a terminal to which an insulated wire may be attached using a pair of pliers.

Another object of the present invention is to provide a terminal having insulation cutting and wire retaining means on one end which can be economically stamped and formed from a coplanar sheet of metal.

Still another object of the present invention is to provide a terminal from which a previously attached wire may be removed and the terminal and wire reused.

DESCRIPTION OF THE PREFERRED EMBODIMENT

Figure 1:
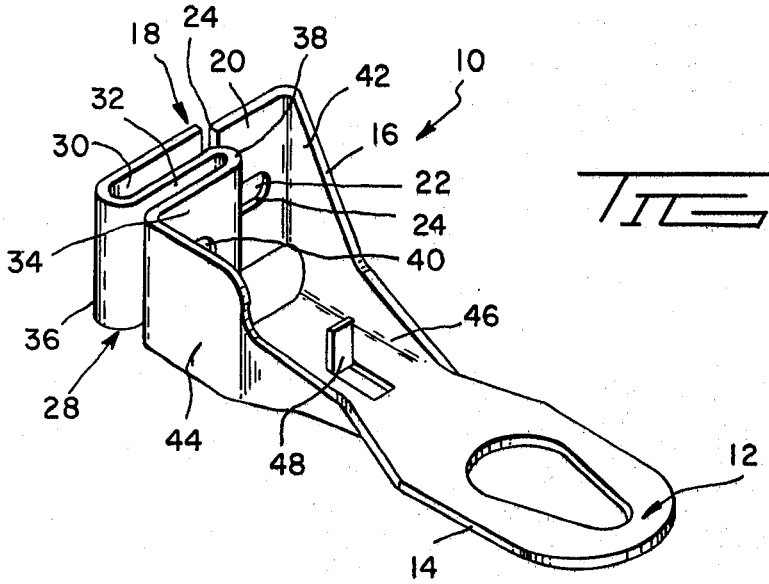
FIG. 1 is a perspective view of the embodiment constructed in accordance with the present invention.

Terminal 10 shown in several drawings includes a conventional ring tongue 12 on the front end 14. Other types of tongues, such as a spade (not shown), may be used as well as other conventional devices for connecting the terminal to electrical connectors such as transformer posts/

The back end 16 of the terminal includes the insulation cutting and meshing wire retaining means 18 of the present invention. On one side is an insulation cutting blade 20. A slot 22 extends down the middle of the blade from its free end 24 to provide cutting edges 26.

On the opposite side from the blade is the wire retaining assembly 28. The assembly consists of three integral walls, a rear wall 30, middle wall 32 and front wall 34. A bight 36 connects the rear and middle walls and a bight 38 connects the middle and front walls. Apertures 40 extend through each wall; the apertures being in direct alignment with each other and positioned in each wall so as to be in alignment with slot 22.

The insulation cutting blade 20 and wire retaining assembly 28 are positioned in a vertical plane transverse to the plane tongue 12 lies in. Blade 20 is attached to the terminal by means of a side wall 42. The retaining assembly 28 is attached to the terminal by means of a side wall 44.

Ends 14 and 16 are separated by a connecting strip 46 from which side walls 42 and 44 rise. A wire stop 48 is stamped out from the strip.

Figure 2:
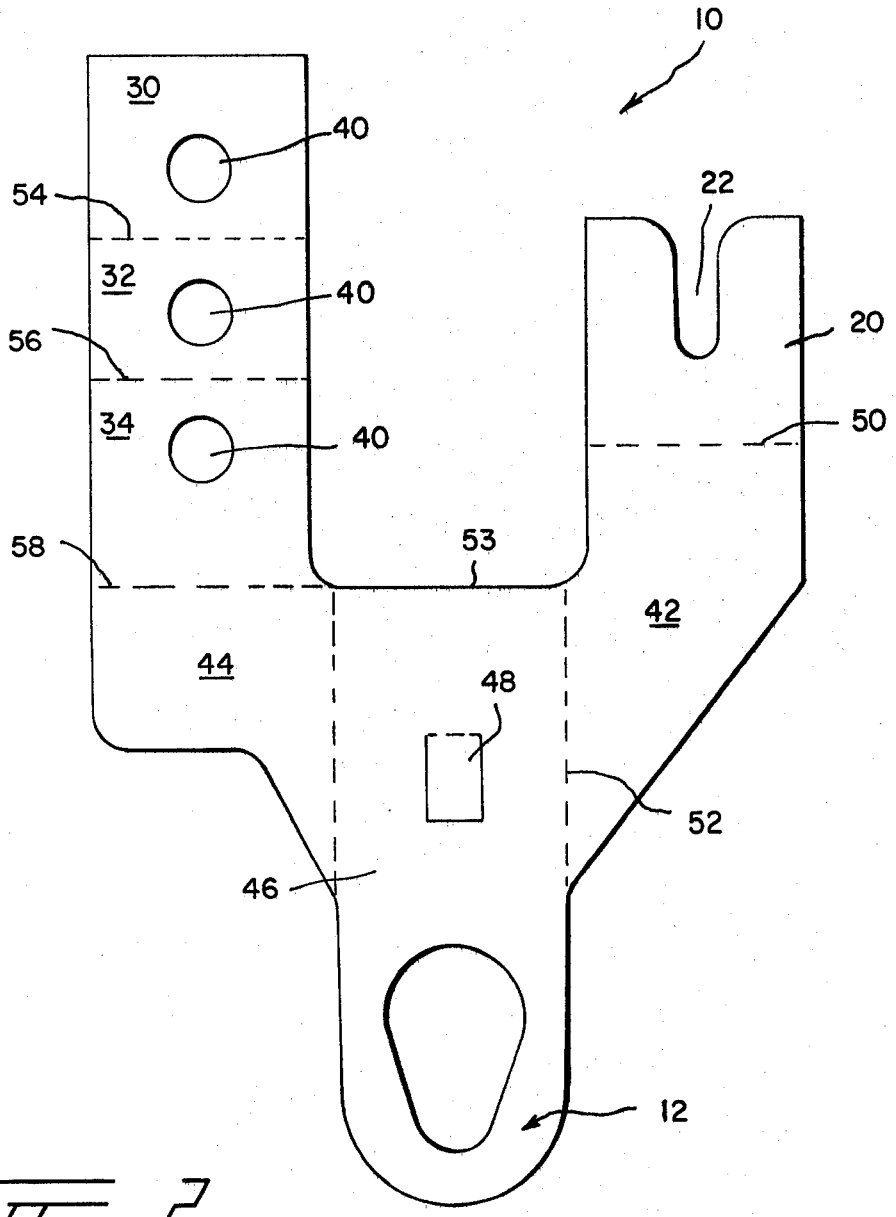
FIG. 2 is a top plan view of the blanked out embodiment prior to being formed.

FIG. 2 shows terminal 10 subsequent to its being blanked out from a coplanar sheet of metal, preferably of a non-resilient material such as brass, and prior to its being formed into the embodiment of FIG. 1. The several dashed lines shown are bend lines.

To form the terminal, blade 20 is bent up along bend line 50 and side wall 42 is bent up along bend line 52. Thereafter the side wall between bend line 50 and rear edge 53 of the connecting strip is bent outwardly slightly. The wire retaining assembly 28 is folded along bend lines 54, 56 and 58 in accordion fashion making sure that apertures 40 are axially concentric. Several methods can be followed in folding the retaining assembly; e.g., the assembly may first be bent upwardly at bend line 58, walls 30 and 32 folded downwardly on bend line 56 and finally wall 30 folded upwardly on bend line 54. Subsequent to the folding, side wall 44 is bent vertically upwardly.

As is apparent from the drawing, side wall 42 extends further rearward then side wall 44. The longer length is required so that insulation cutting blade 20 can slide in between walls 30 and 32 as shown in FIG. 5.

Upon bending wire stop 48 vertically upwardly, the forming of the terminal is complete.

Figure 3:
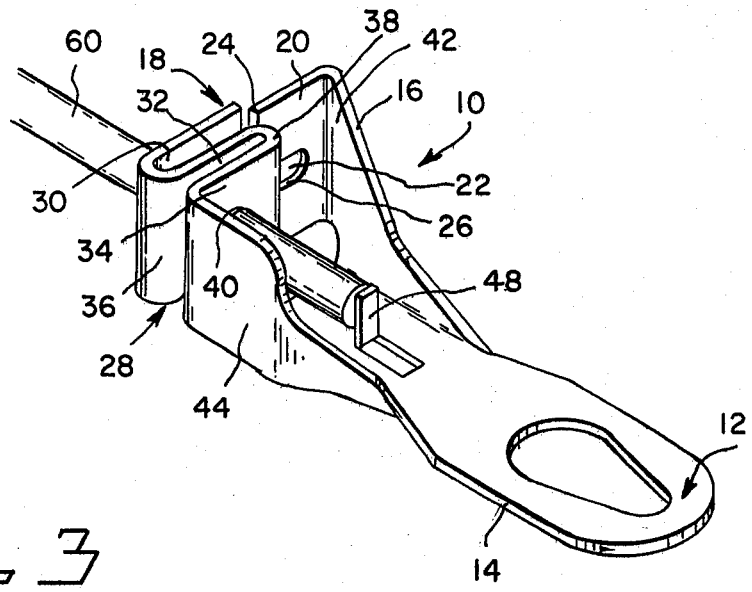
FIGS. 3, 4 and 5 illustrate the step-by-step method of attaching a wire to the embodiment of FIG. 1.
Figure 4:
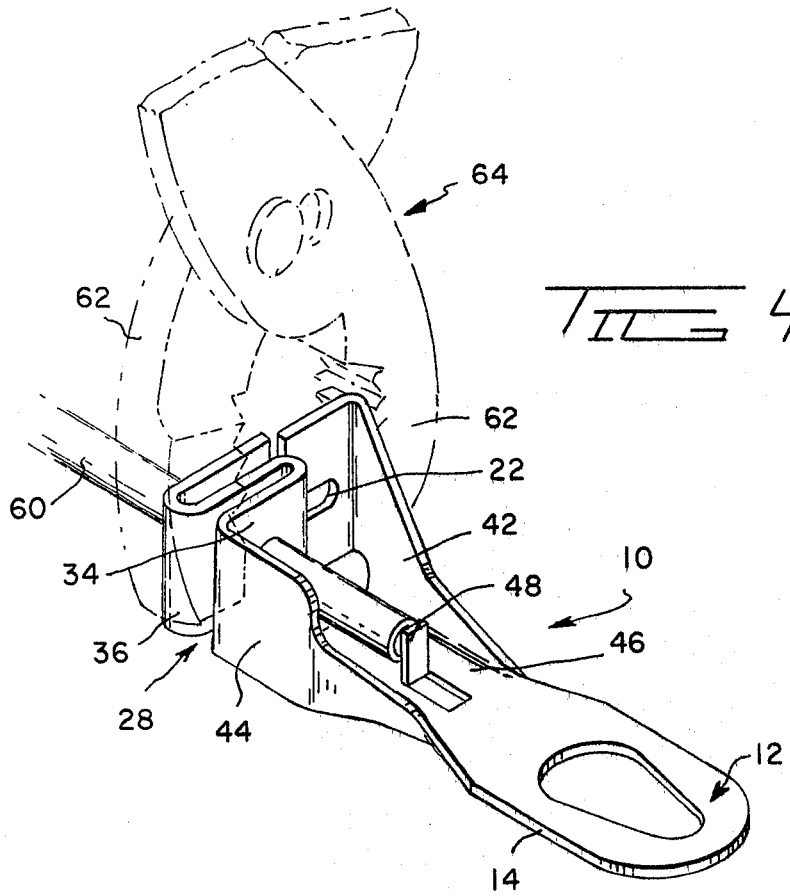
Figure 5:
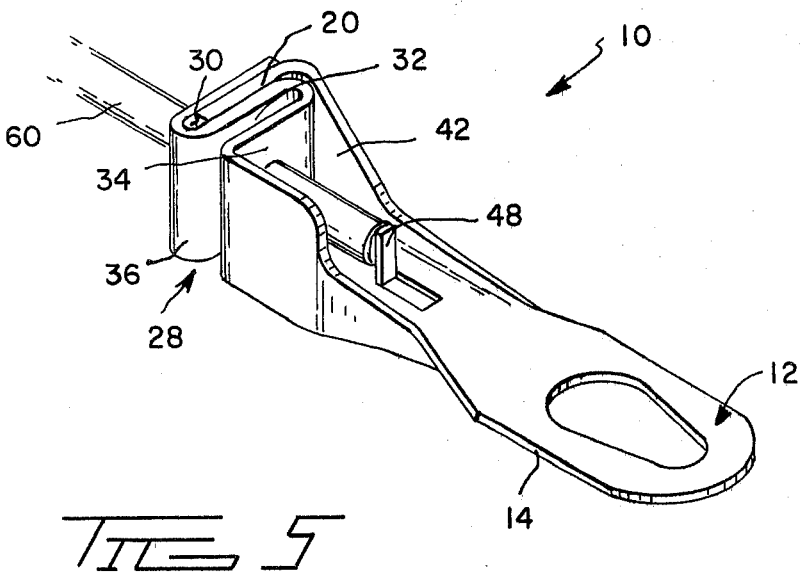

FIGS. 3, 4 and 5 illustrate the utility of terminal 10. In FIG. 3, the end of insulated wire 60 is inserted through apertures 40 until it abuts wire stop 48. The back end 16 of terminal 10 is then placed between jaws 62 of pliers 64 as shown in FIG. 4 and the insulation cutting and wire retaining means 18 are squeezed together with insulation cutting blade 20 sliding in between rear wall 30 and middle wall 32. Wire 60 enters slot 22 and the edges thereof cut through the insulation making contact with the underlying conductor. As the material used is non-resilient, the deformation of side walls 42 and 44 brought about by the squeezing between the plier jaws is fixed. However, one may remove wire 60 by prying apart blade 20 from retaining assembly 28 and withdrawing the wire from apertures 40. Thereafter the wire and terminal may be reused.

The forgoing detailed description has been given for clearness of understanding only, and no unnecessary limitations should be understood therefrom, as some modifications will be obvious to those skilled in the art.

What is claimed is:

1. An electrical terminal stamped and formed from a coplanar sheet of conductive material, comprising:

a. a connecting strip;

b. means at the front end of the strip for attachment to electrical connectors;

c. vertical side walls extending rearwardly from each side of the strip with the ends of the side walls being movable towards each other;

d. an insulation cutting blade attached to the end of one side wall and positioned transverse to the longitudinal axis of the terminal, said blade having a wire-receiving slot therein with the opening being towards the other side wall; and e. a wire retaining assembly attached to the end of the other side wall and positioned transverse to the longitudinal axis of the terminal, said assembly having a front, middle and rear walls with a blade-receiving opening between the middle and rear walls, and aligned apertures in the walls adapted to receive a wire therethrough, so that with a wire positioned through the apertues, the side walls may be squeezed together causing the blade to enter into the blade-receiving opening thereby driving the wire into the slot so that the edges thereof may cut through the insulation and electrically contact the underlying conductor.

2. The electrical terminal of claim 1 further including a wire stop positioned in the connecting strip.

* * * * *